United States Patent [19]

Elder

[11] 3,945,558

[45] Mar. 23, 1976

[54] PAPERBOARD BULK BIN

[75] Inventor: Jerome Earl Elder, Minneapolis, Minn.

[73] Assignee: International Paper Company, New York, N.Y.

[22] Filed: Nov. 19, 1974

[21] Appl. No.: 525,050

[52] U.S. Cl. ..... 229/23 R; 229/41 B; 229/41 C

[51] Int. Cl.[2] ..... B65D 5/32

[58] Field of Search..... 229/5.5, 23 R, 23 A, 37 R, 229/38, 39 R, 39 B, 41 R, 41 B, 41 C, 41 D

[56] References Cited

UNITED STATES PATENTS

| | | | |
|---|---|---|---|
| 1,397,756 | 11/1921 | Drysdale | 229/37 R |
| 1,904;365 | 4/1933 | Geist | 229/37 R X |
| 2,085,239 | 6/1937 | Towell | 229/41 C |
| 2,091,291 | 8/1937 | Ringler | 229/37 R |
| 2,160,488 | 5/1939 | Ringler | 229/5.5 X |
| 2,176,944 | 10/1939 | Ringler | 229/5.5 |
| 2,459,727 | 1/1949 | Tillery | 229/5.5 X |
| 2,459,728 | 1/1949 | Tillery | 229/5.5 X |
| 2,687,070 | 8/1954 | Gastright | 93/53 |
| 3,000,496 | 9/1961 | Larson | 229/41 C X |
| 3,040,960 | 6/1962 | Younger | 229/38 |
| 3,253,767 | 5/1966 | Pellaton | 229/37 R |
| 3,526,532 | 9/1970 | Swett | 229/39 R |

*Primary Examiner*—William Price
*Assistant Examiner*—Stephen Marcus
*Attorney, Agent, or Firm*—Ronald A. Schapira

[57] ABSTRACT

A paperboard, bulk bin for heavy, palletized loads of meat and the like, which includes:

a side wall that is formed by a plurality of alternating, foldably connected, substantially rectangular, upstanding side panels and corner panels; each of the side panels having a horizontally disposed, substantially rectangular flap, foldably connected to its bottom edge; each of the corner panels having a horizontally disposed, four sided, tapered flap foldably connected to its bottom edge; and each of the tapered flaps and rectangular flaps being foldably connected to a triangular gusset panel, horizontally disposed between them; and a bottom wall that is formed by a substantially flat, horizontally disposed panel insert having a perimeter corresponding to the bottom edges of the side panels and corner panels and overlying the tapered flaps, rectangular flaps and gusset panels;

the angle in each gusset panel which is included between the rectangular flaps and the tapered flaps being equal to 180° divided by the number of triangular gusset panels; and the edge of each of the tapered flaps connected to the corner panels being equal to or greater than twice the width of the rectangular flaps times the cosine of [90° minus twice the angle in the triangular gusset panels included between the rectangular and tapered flaps].

14 Claims, 9 Drawing Figures

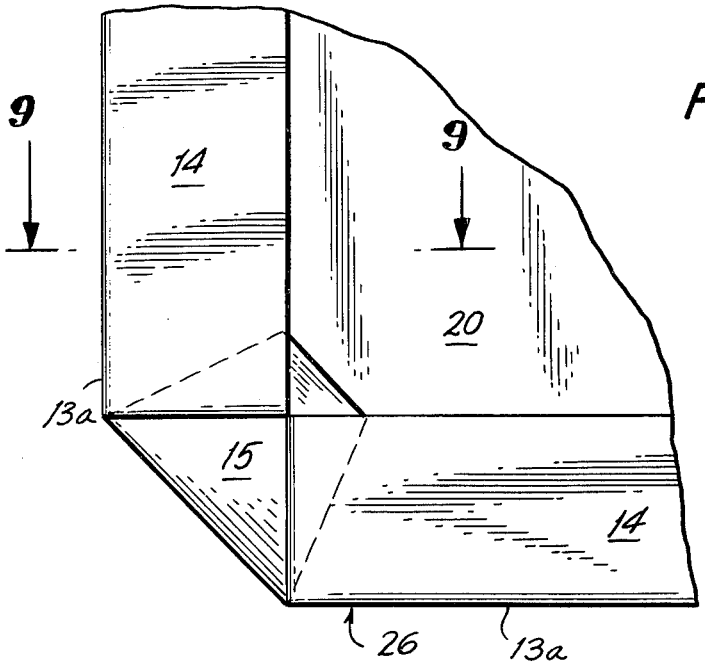
FIG. 8
FIG. 9
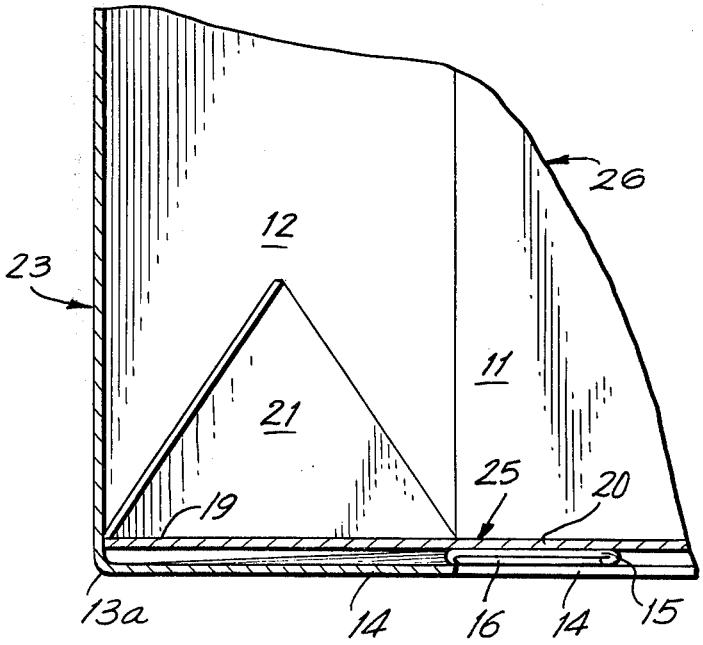

PAPERBOARD BULK BIN

BACKGROUND OF THE INVENTION

This invention relates to a paperboard, bulk bin for relatively heavy quantities, on the order of about 2,000 pounds, of cut-up meat and the like. This invention is particularly concerned with a bin for relatively heavy, palletized loads which are to be moved from place to place. This invention is also particularly concerned with a bin which has a flat bottom and which will not be prone to tip-over or break-apart when the relatively heavy, palletized load is in motion or is brought to a sudden stop. This invention is quite particularly concerned with bins for use in centralized meat-cutting operations.

Paperboard bins for relatively small quantities of materials are well known in the art. See, for example, U.S. Pat. Nos. 1,397,756, 1,904,365, 2,085,239, 2,091,291, 2,459,727, 2,459,728, 2,687,070, 3,000,496, 3,253,767, and 3,526,352. Often, such bins have been formed with a side seamed, upstanding side wall and a bottom which includes a plurality of interfolded flaps, connected to the side wall. See, for example, U.S. Pat. Nos. 1,397,756, 1,904,365 and 2,687,070. However, such bins have been entirely inappropriate for relatively heavy loads. This has been due to the fact that the cuts provided in the bins, between flaps in the bottom construction, have provided sites where the bins have been prone to tear and break under the weight of heavy loads of material. Often, such bins also have been provided with recessed bottoms. See, for example, U.S. Pat. Nos. 2,091,291, 2,459,727, 2,459,728, and 3,000,496. However, such bins also have been completely unsatisfactory for use with relatively heavy loads. This has been so because the bottom constructions have invariably collapsed under the weight of heavy loads in the bins, causing the bins to tip-over and break.

There has been an unfilled need therefore for a paperboard, bulk bin for relatively heavy quantities of materials. This need has been especially acute in centralized meat-cutting operations.

Centralized meat-cutting operations, involving the mechanized cutting-up, packaging and shipping of large quantities of fresh meat, have required a heavy duty, bulk bin that can be easily formed, filled and moved from place to place to pallets. In order to be satisfactory for use in a centralized meat-cutting operation, the bin has had to be designed to hold relatively large quantities of meat, on the order of about 2,000 pounds. The bin also has had to be rugged enough to withstand abuse during the handling and moving of such bins from place to place on pallets in the centralized meat-cutting operation. The bin further has had to be adapted to being quickly and easily set-up, preferably by a single workman, at the site of the centralized meat-cutting operation from a folded, tubular blank.

SUMMARY OF THE INVENTION

In accordance with this invention, a paperboard, bulk bin is provided which comprises:

a side wall formed from a plurality of alternating, foldably connected, substantially rectangular, upstanding side panels and corner panels; each of said side panels having a horizontally disposed, substantially rectangular flap, foldably connected to the bottom edge thereof; each of said corner panels having a horizontally disposed, four-sided, tapered flap foldably connected to the bottom edge thereof; and each of said tapered flaps and said rectangular flaps being foldably connected to a triangular gusset panel, horizontally disposed between them; and a bottom wall formed from a substantially flat, horizontally disposed panel insert having a perimeter corresponding to the bottom edges of said side and corner panels and overlying said rectangular and tapered flaps and said gusset panels;

the included angle in each of said gusset panels between said rectangular flaps and said tapered flaps being equal to about 180° divided by the number of triangular gusset panels; and the edge of each of said tapered flaps connected to said corner panels being equal to or greater in length than twice the width of said rectangular flaps times the cosine of [90° minus twice the included angle in said triangular gusset panels between said rectangular and tapered flaps].

In accordance with another aspect of this invention, a paperboard blank is provided which can be formed into the side wall of the bulk bin, having: a plurality of alternating side panels and corner panels; rectangular flaps and four-sided tapered flaps connected to the side and corner panels respectively; and triangular gusset panels connected to the flaps.

By the improved constructions for a bin and for a blank for the side wall of the bin of this invention, a bulk bin for relatively heavy loads of meat and the like is provided which is strong, which has a flat bottom and can stand stably on a moving pallet without tipping-over or bursting, and which can also be easily and rapidly assembled by a single workman for use in a centralized, meat-cutting operation.

DESCRIPTION OF THE DRAWINGS

FIG. 8 is a fragmentary, plan view of the exterior of the bottom of the bulk bin, after the bottom wall has been urged downwardly, from its position in FIG. 7, so that the flaps are horizontally disposed beneath the bottom wall.

FIG. 9 is a fragmentary, sectional view taken along line 9—9 in FIG. 8, showing the bottom wall of the bulk bin on top of the horizontally disposed flaps, connected to the side wall of the bulk bin.

DETAILED DESCRIPTION OF THE INVENTION

Figure 1:
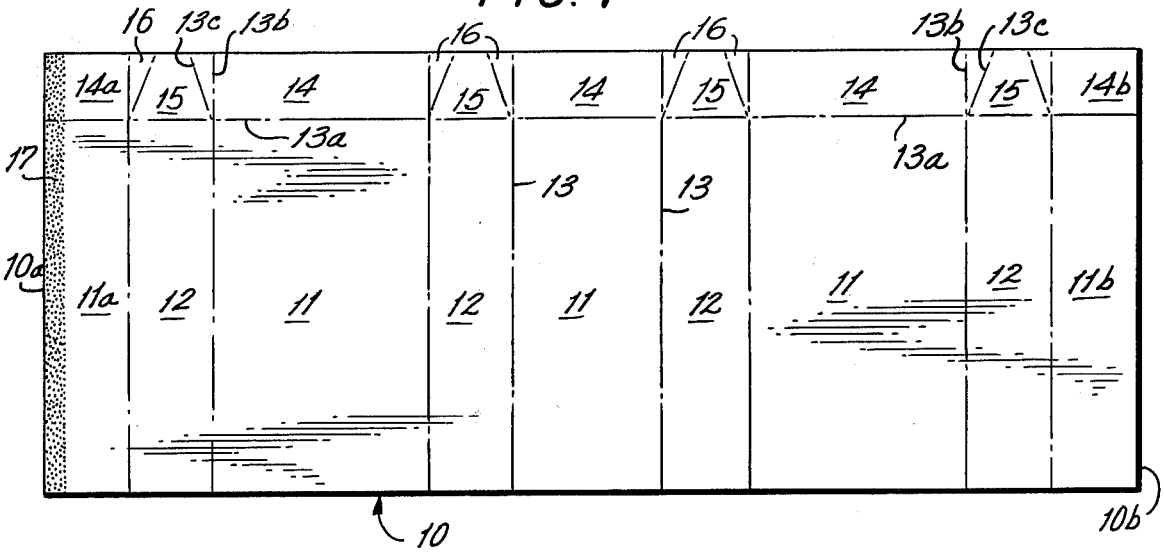
FIG. 1 is a plan view of a paperboard blank which can be formed into the side wall of the bulk bin of this invention.

Shown in FIG. 1 is a paperboard blank, generally 10, which can be formed into the side wall of the bulk bin of this invention. The side wall blank 10 includes a plurality of alternating, substantially rectangular, side panels 11 and corner panels 12 and a plurality of scored, fold lines, generally 13. The side panels 11 and corner panels 12 are foldably connected along a plurality of the fold lines 13 between the side and corner panels 11 and 12. Foldably connected to one edge of each of the side panels 11 is a substantially rectangular flap 14, and foldably connected to one edge of each corner panel 12 is a four-sided, tapered flap 15. The rectangular flaps 14 and tapered flaps 15 are foldably connected to their respective side panels 11 and corner panels 12 along a single, scored, fold line 13a.

For purposes of this Description, the edge of each panel 11 and 12, along fold line 13*a*, will be considered as the widthwise edge thereof, and the edge of each flap 14 and 15, along fold line 13*a*, will be considered as the lengthwise edge thereof. Hence, in the side wall blank 10, the width of each side panel 11 equals the length of each rectangular flap 14, and the width of each corner panels 12 equals the length of each tapered flap 15.

The rectangular flaps 14 and tapered flaps 15 are also foldably connected to triangular gusset panels 16. Each of the rectangular flaps 14 is connected to a triangular gusset panel 16 along a scored, fold line 13*b*, which defines the width of the rectangular flap 14. Likewise, each of the tapered flaps 15 is foldably connected to a triangular gusset panel 16 along an angled, scored, fold line 13*c*. The fold lines 13*b* and 13*c* of each triangular gusset panel 16 intersect at a point, along fold line 13*a*, where the fold lines 13, separating the side panels 11 and corner panels 12, intersect fold line 13*a*.

The side wall blank 10 can, if desired, also be provided with an adhesive pattern 17 on one or more surface portions thereof, adjacent a width-wise edge 10*a* thereof. The adhesive pattern 17 can be provided on either a side panel 11 and rectangular flap 14 or on a corner panel 12 and tapered flap 15. As shown in FIG. 1, the edge portion of the side wall blank 10 containing the adhesive pattern 17 is an edge portion of half of a side panel 11 and of half of a rectangular flap 14. The half 11a of the halved side panel 11 and the half 14*a* of the halved rectangular flap 14, containing the adhesive pattern 17, are located at one end of the blank 10, adjacent blank edge 10*a*. The other half 11*b* of the halved side panel 11 and the other half 14*b* of the halved rectangular flap 14 are located adjacent the opposite, widthwise edge 10*b* of the side wall blank 10. When the adhesive pattern 17 on one end of the side wall blank 10 is attached to the other end of the blank 10, a full-sized, side panel 11 and rectangular flap 14 are obtained having a double thickness where the two half side panels 11*a* and 11*b* and the two half rectangular flaps 14*a* and 14*b* overlap.

Figure 2:
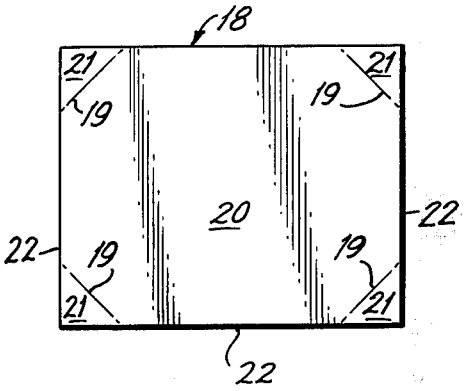
FIG. 2 is a plan view of a paperboard blank which can be formed into the bottom wall of the bulk bin of this invention.

Shown in FIG. 2 is a blank, generally 18, which can be formed into the bottom wall of the bulk bin of this invention. The bottom wall blank 18 includes a plurality of scored, fold lines 19, which define a central, bottom panel 20 and a plurality of triangular corner panels 21.

The bottom panel 20 has a predetermined shape and size, adapted to act in cooperation with the side and corner panels 11 and 12 of the side wall blank 10, in the bulk bin of this invention. For this purpose, in the bottom wall blank 18, the fold lines 19 have a length about equal to the width of the corner panels 12, as measured along fold line 13*a*. Also for this purpose, the edges 22 of the bottom panel 20, which lie between the fold lines 19 in the bottom wall blank 18, have a length about equal to the width of the side panels 11, as measured along fold line 13*a*. On the other hand, if desired, the same purpose can be served by having the fold lines 19 with the same length as the width of the side panels 11 and the edges 22 with the same length as the width of the corner panels 12. In any case, it is considered that the compatibility of the shape of the central panel 20 with the widths of the panels 11 and 12 is critical in the bulk bin of this invention. However, neither the shape nor the inclusion of the triangular corner panels 21 is considered an essential part of the bulk bin of this invention.

The side wall blank 10 and bottom wall blank 18 can be formed of any paperboard material conventionally utilized in bulk bins. The selection of a particular thickness and weight of paperboard material for a bulk bin will depend upon the weight and quantity of material to be held in the bulk bin. For loads of cut-up meat and the like weighing about 2,000 pounds, it is preferred that the blanks 10 and 18 be formed from a single wall, corrugated board, such as a board having a thickness of about 0.177 inches and a weight of about 210 lbs./1000 sq. ft., or a double wall, corrugated board, such as a board having a thickness of about 0.325 inches and a weight of about 240 lbs./1000 sq. ft. The particularly preferred paperboard materials for the blanks 10 and 18 are the double wall, corrugated boards. If desired, one or both surfaces of the blanks 10 and 18 can be coated with a film of a barrier material, such as a moisture barrier material. Among the barrier materials which can be suitably utilized are the polyolefins, such as polyethylene and polypropylene, and saran. Preferably, the paperboard material utilized in the blanks 10 and 18 is a water resistant material, and no additional barrier material is utilized on its surface.

In the side wall blank 10, shown in FIG. 1, certain proportions of its members are considered critical to assure that the resulting bulk bin will stand stably on a pallet, when filled with about 2,000 pounds of meat and the like, and to assure that the bulk bin and its flaps and panels will not be damaged during use of the loaded bin. In this regard, it is considered necessary that the rectangular flaps 14, tapered flaps 15 and triangular gusset panels 16 be so proportioned that they can be properly disdisposed, relative to each other, perpendicular to the side panels 11 and corner panels 12 and substantially horizontal in the bulk bin formed from the side wall blank 10. For this purpose, it is believed essential that: the included angle in each triangular gusset panel 16, between the rectangular flaps 14 and tapered flaps 15, i.e., between fold lines 13*b* and 13*c*, be equal to about 180° divided by the number of triangular gusset panels 16 in the side wall blank 10; and that the length of each tapered flap 15, as measured along fold line 13*a*, be equal to or greater than twice the width of the rectangular flaps 14, as measured along fold line 13b, times the cosine of [90° minus twice the angle in the triangular gusset panels 16 included between the rectangular flaps 14 and tapered flaps 15, i.e., 90° minus twice the angle between fold lines 13*b* and 13*c*]. When these conditions are met in the side wall blank 10, the resulting bulk bin can be used as intended. As placed on a pallet and filled, the bulk bin stands on its horizontally disposed flaps 14 and 15, without danger of its tipping-over or bursting during movement of the pallet. Also, its side panels 11, corner panels 12, flaps 14 and 15 and gusset panels 16 do not tend to become weakened, in use, by being crimped or bent.

The side wall blank 10 in FIG. 1 is shown as having four side panels 11, four corner panels 12, four rectangular flaps 14, four tapered flaps 15 and eight gusset panels 16. The included angle in each gusset panel 16, between the flaps 14 and 15, is about 180°/8 or about 22½°. The corresponding bottom wall blank 18 is shown in FIG. 2, having an eight sided, bottom panel 20 defined by four fold lines 19 and four edges 22. However, the blanks 10 and 18 for forming a bulk bin in accordance with this invention are not limited to this particular configuration. In fact, the side wall blank 10 can, if desired, suitably include from 4 to 12, preferably 6 to 8, alternating side and corner panels 11 and 12 and a corresponding number of flaps 14 and 15 and gusset panels 16, and the bottom wall blank 18 can suitably include a bottom panel 20 of 4 to 12 sides. Likewise, in the side wall blank 10 of FIG. 1, the side panels 11 are shown as substantially wider than the corner panels 12, and correspondingly, in the bottom wall blank 18, the bottom panel edges 22 are substantially longer than the fold lines 19. However, such proportions also are not required in the blanks 10 and 18 in accordance with this invention. On the other hand, the eight panels 11 and 12 and corresponding flaps 14 and 15 and gusset panels 16 of the side wall blank 10 of FIG. 1 and the corresponding eight sides of the bottom panel 20 in the bottom wall blank 18 of FIG. 2, wherein the side panels 11 are substantially wider than the corner panels 12 and, correspondingly, the bottom panel edges 22 are longer than the fold lines 19, provide, in combination, a preferred, bulk bin, having a substantially square shape which is adapted to occupy the minimum amount of space on a pallet.

Figure 3:
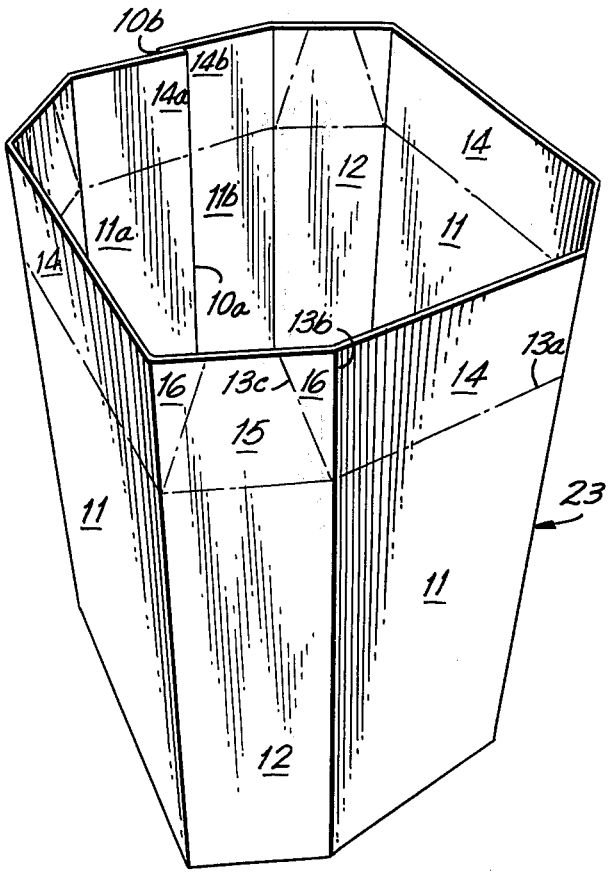
FIG. 3 is a perspective view of a cylinder formed by side seaming the blank of FIG. 1.

Shown in FIG. 3 is a tubular blank or cylinder, generally 23, formed by side seaming the side wall blank 10 along its widthwise edges 10*a* and 10*b*. The side and corner panels of the cylinder 23 form the side wall of the bulk bin of this invention. As seen in FIG. 3, the cylinder 23 is formed by bonding the two side panel halves 11*a* and 11*b* and the two rectangular flap halves 14*a* and 14*b*, adjacent the widthwise edges 10*a* and 10*b* of the side wall blank 10. For this purpose, the adhesive pattern 17 on the side wall blank 10, adjacent its first widthwise edge 10*a*, is bonded to the portion of the side wall blank 10 adjacent its opposite widthwise edge 10*b*. Preferably, the two side panel halves 11*a* and 11*b* and the two rectangular flap halves 14*a* and 14*b*, adjacent the widthwise edges 10*a* and 10*b* of the side wall blank 10, are stapled together, either with or without the use of the adhesive pattern 17. The use of staples in side seaming the blank 10 assures a strong bond between the opposite, widthwise edges of the blank 10. For this purpose, any conventional, strong staples can be utilized. It is especially preferred that the edges 10*a* and 10*b* of the blank 10 be adhered with both staples for strength and an adhesive pattern 17 for added strength and for sealant purposes.

Figure 4:
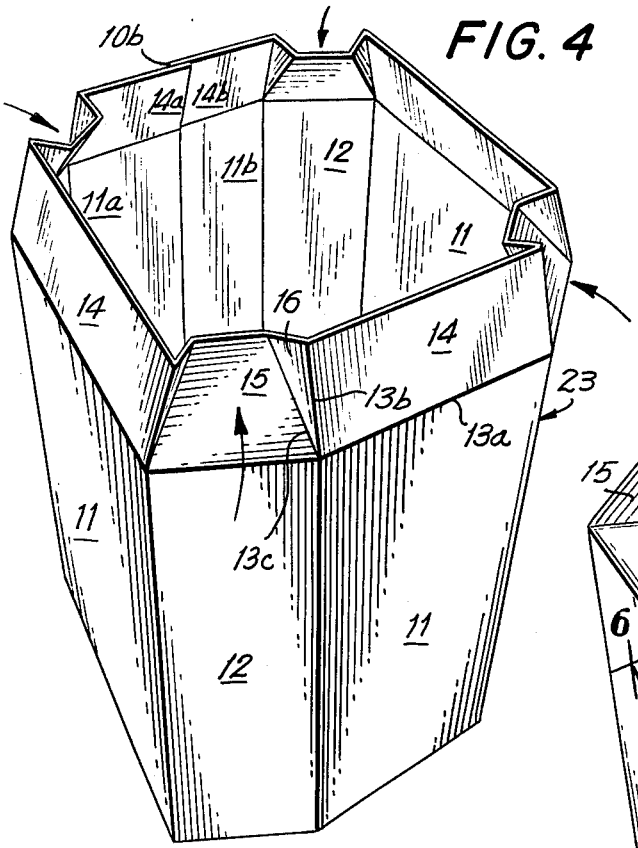
FIG. 4 is a perspective view of the cylinder of FIG. 3 in which the flaps, provided along an edge of the cylinder, have been urged somewhat inwardly of the cylinder.

Shown in FIG. 4 is an intermediate step in forming the bulk bin of this invention from the cylinder 23. The flaps 14 and 15 and the triangular gusset panels 16 have been partially folded about the fold line 13*a*, which separates the flaps 14 and 15 from the side panels 11 and corner panels 12. In accordance with this invention, it has been found that the bulk bin of this invention can be expeditiously formed by one workman, merely by placing the cylinder 23 on the floor with its flaps 14 and 15 facing upward, as shown in FIG. 3, and urging the tapered flaps 15 inwardly and downwardly of the cylinder 23. Urging the tapered flaps 15 inwardly and downwardly of the cylinder 23 results in the tapered flaps 15 and rectangular flaps 14 being folded about the fold line 13*a*. Urging the tapered flaps 15 inwardly and downwardly of the cylinder 23 also causes the triangular gusset panels 16 to fold about the fold lines 13*b* and 13*c* separating the gusset panels from the rectangular flaps 14 and tapered flaps 15.

Figure 5:
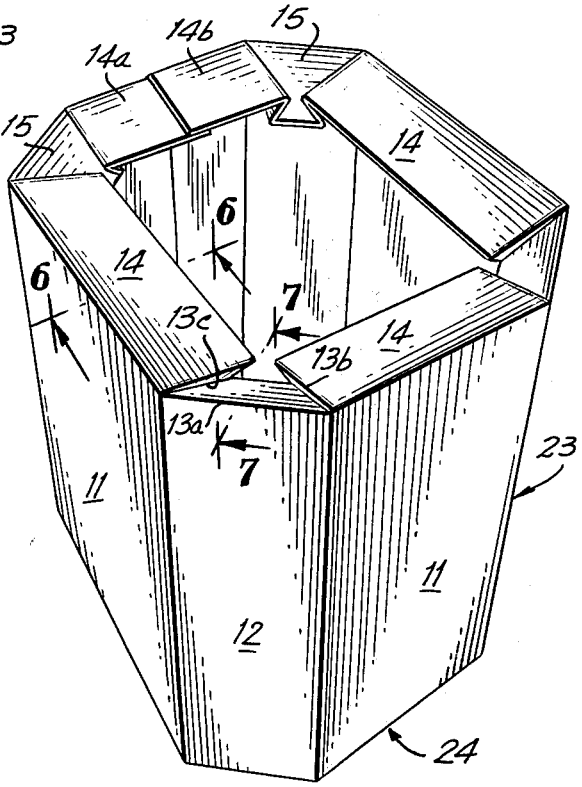
FIG. 5 is a perspective view of the cylinder of FIGS. 3 and 4, in which the flaps, provided along an edge of the cylinder, have been urged inwardly of the cylinder so that the free edges thereof are positioned interiorly of the cylinder.
Figure 6:
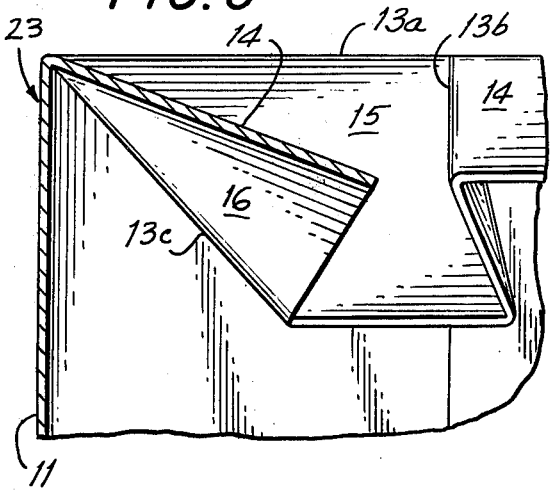
FIG. 6 is a fragmentary, sectional view taken along line 6—6 in FIG. 5.

When all of the tapered flaps 15 have been urged inwardly and downwardly of the cylinder 23, past the plane formed by the fold line 13*a*, each rectangular flap 14, tapered flap 15 and triangular gusset panel 16 is surrounded by the side panels 11 and corner panels 12, and the free edges of the flaps 14 and 15 and gusset panels 16 are positioned interiorly of the cylinder 23. This position of the flaps and gusset panels is shown in FIGS. 5 and 6. The flaps and gusset panels, once urged past the plane formed by fold line 13*a*, stay within the cylinder 23. They do not tend to spring out of the cylinder 23, but, rather, they tend to remain in place and to provide a somewhat rigid perimeter for the cylinder 23 along fold line 13*a*. Because the flaps and gusset panels tend to stay inwardly of the cylinder, a workman can easily turn over the resulting cylinder 23 of FIGS. 5 and 6, so that the fold line 13*a* rests on the floor and the flaps 14 and 15 and gusset panels 16 extend upwardly into the cylinder 23.

That the flaps 14 and 15 and gusset panels 16 maintain their position inwardly of the cylinder 23, once pushed past the plane formed by fold line 13*a*, is a significant feature of this invention. It enables a single individual to form the side wall portion of the bulk bin of this invention merely by pressing the tapered flaps 15 inwardly of the cylinder until they pop into position, interiorly of the cylinder 23. That the resulting cylinder has a somewhat rigid perimeter is also quite advantageous in allowing one workman to turn the cylinder 23 over to receive the bottom wall blank 18, of FIG. 2, as an insert. Because the rectangular flaps 14, tapered flaps 15 and gusset panels 16 stay interiorly of the cylinder 23, once urged inwardly of the cylinder 23, to maintain a rigid perimeter for the cylinder 23, one workman can turn the bin over and insert the bottom wall blank 18 through the open end 24 of the cylinder 23 without fear of the cylinder 23 collapsing along the fold lines 13.

Figure 7:
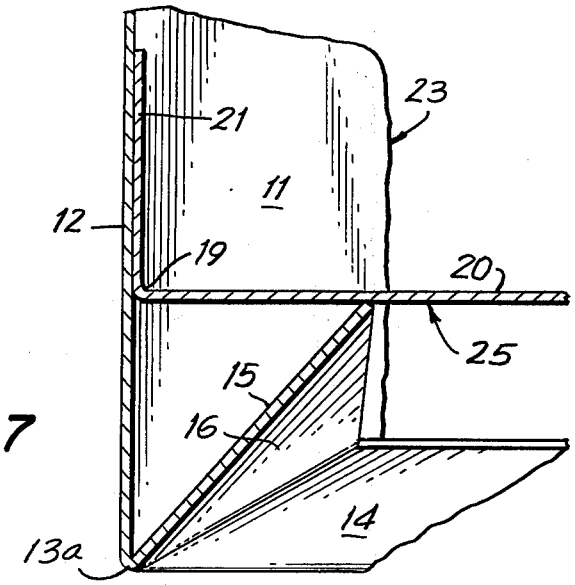
FIG. 7 is a fragmentary, sectional view, taken along line 7—7 in FIG. 5, after the cylinder of FIG. 5 has been turned-over and the bottom wall, formed from the blank of FIG. 2, has been horizontally disposed in the cylinder of FIG. 5, on top of the inwardly positioned flaps.

As shown in FIG. 7, a bottom wall insert 25, formed from the bottom wall blank 18 of FIG. 2, is inserted in the cylinder 23 of FIGS. 5 and 6 on top of the flaps 14 and 15 and gusset panels 16. The bottom wall insert 25 is formed merely by folding all the triangular corner panels 21 along the fold lines 19 in the bottom wall blank 18. After being formed from the blank 18, the bottom wall insert 25 is placed into the open mouth 24 of the cylinder 23. The bottom panel 20 of the bottom wall insert 25 forms the bottom wall of the bulk bin of this invention.

As also seen in FIG. 7, as positioned inside the cylinder 23, the bottom panel 20 of the bottom wall insert 25 is horizontally disposed on top of the rectangular flaps 14, tapered flaps 15 and triangular gusset panels 16, connected to the side and corner panels 11 and 12 of the cylinder 23. The flaps and gusset panels 14, 15 and 16 are upwardly disposed in the cylinder 23, beneath the bottom wall insert 25. The triangular corner panels 21 of the bottom wall insert 25 preferably are disposed perpendicularly upward relative to the bottom panel 20 and adjacent to the corner panels 12. The scored, fold lines 19 of the bottom wall insert 25, as positioned in the cylinder 23, abut the corner panels 12 of the cylinder 23.

As shown in FIGS. 8 and 9, the bottom wall insert 25 and the bottom panel 20 have been urged downwardly in the cylinder 23 from their position in FIG. 7, to form the bulk bin construction, generally 26, of this invention. In the bulk bin 26, all of the rectangular flaps 14, tapered flaps 15 and gusset panels 16 of the cylinder 23 are horizontally disposed, beneath the bottom panel 20. Each triangular gusset panel 16 is disposed between an adjacent rectangular flap 14 and an adjacent tapered flap 15, preferably above the rectangular flap 14 and beneath the tapered flap 15. After all of the flaps and gusset panels 14, 15 and 16 of the cylinder 23 and the bottom panel 20 of the bottom wall insert 25 have been urged downwardly, into a horizontal position, as by pushing down upon the bottom wall insert 25 or by commencing the filling of the bulk bin, the bulk bin 26 of this invention is formed and ready to hold relatively heavy quantities of meat and the like on a pallet.

As seen in FIG. 9, in the bulk bin 26 of this invention, the triangular corner panels 21 of the bottom wall insert 25 preferably are located against the corner panels 12 of the cylinder 23. As also seen in FIG. 9, the plurality of fold lines 19 in the bottom wall insert 25 preferably abut against the corner panels 12, adjacent the fold line 13*a*. As further seen in FIG. 9, the flaps 14 and 15 and gusset panels 16 of the cylinder 23 are preferably horizontally disposed and pressed together by the bottom panel 20 of the bottom wall insert 25, and the edges 22 of the bottom panel 20 of the bottom wall insert 25 preferably abut against the side panels 11, adjacent the fold line 13*a*, of the cylinder 23. As still further seen in FIG. 10, fold line 13*a* and rectangular flaps 14 lie substantially within the same, horizontal plane, which constitutes the bottom of the bulk bin 26.

In combination, the elements of the cylinder 23 and bottom wall insert 25, as shown in FIG. 9, provide a substantially flat-bottomed, stable, bulk bin 26 for relatively heavy loads of meat and the like. The bulk bin 26 stands, without tipping-over or bursting, when being loaded with large quantities of meat or when filled and moved on a pallet. Also, because of the intimate, abutting relationship between the elements of the bottom wall insert 25 and the cylinder 23, moisture and fluids, which may leak from the meat, will tend to stay in the bulk bin.

The bulk bin 26 in accordance with this invention can be disposed of, after use, or can be expeditiously taken apart for subsequent reuse. The design of this bulk bin is such that, generally, it is not significantly damaged or weakened during assembly or use. For this reason, it can be suitably reused many times.

As set forth above, the preferred bulk bin construction 26 in accordance with this invention includes four side panels 11 and four corner panels 12 in the cylinder 23 and four, corresponding, triangular corner panels 21 and four edges 22, between the scored, fold lines 19, in the bottom wall insert 25. It is also preferred that the panels in the cylinder 23, designated as side panels 11, be wider than the panels in the cylinder 23 designated as corner panels 12. However, in accordance with this application, it is not necessary that four side panels and four corner panels be utilized or that the side panels be wider than the corner panels. In fact, the relative dimensions and number of elements of the side wall blank 10 and bottom wall blank 18 can be varied within wide limits to provide the bulk bin construction 26 of this invention which can stably hold large quantities of meat and the like, which is designed so that the paperboard elements thereof are not unduly weakened or abused during use of the bulk bin construction and which can be easily and quickly assembled by a single workman.

It is thought that the invention and many of its attendant advantages will be understood from the foregoing description and it will be apparent that various changes may be made in the form, construction and arrangement of the parts without departing from the spirit and scope of the invention or sacrificing all of its material advantages, the form hereinbefore described being merely a preferred embodiment thereof.

I claim:

1. A paperboard bulk bin, comprising:

a side wall formed from a plurality of alternating, foldably connected, substantially rectangular, upstanding side panels and corner panels; each of said side panels having a horizontally disposed, substantially rectangular flap, foldably connected to the bottom edge thereof; each of said corner panels having a horizontally disposed, four-sided, tapered flap foldably connected to the bottom edge thereof; and each of said tapered flaps and said rectangular flaps being foldably connected to a triangular gusset panel, horizontally disposed between them; and a bottom wall formed from a substantially flat, horizontally disposed panel insert having a perimeter corresponding to the bottom edges of said side and corner panels and overlying said rectangular and tapered flaps and said gusset panels;

the included angle in each of said gusset panels between said rectangular flaps and said tapered flaps being equal to about 180° divided by the number of said gusset panels; and the edge of each of said tapered flaps connected to said corner panels being equal to or greater in length than twice the width of said rectangular flaps times the cosine of [90° minus twice the included angle in said gusset panels between said rectangular and tapered flaps].

2. The bin of claim 1 which includes four side panels, four corner panels, four rectangular flaps, four tapered flaps and eight gusset panels; and the included angle in said gusset panels is about 22½°.

3. The bin of claim 1 wherein said bin is formed from a single wall or double wall, corrugated board.

4. The bin of claim 1 wherein said side panels are substantially longer than said corner panels.

5. The bin of claim 1 wherein said foldably connected side panels, corner panels, rectangular flaps, tapered flaps and gusset panels are connected along scored, fold lines.

6. The bin of claim 1 wherein said bottom wall comprises: a central panel having a plurality of straight edge portions of alternating length, each edge portion having a length about equal to either the width of said side panels or said corner panels; and a triangular corner panel, connected to a straight edge portion of said central panel and disposed perpendicularly to said central panel.

7. The bin of claim 6 wherein a plurality of triangular corner panels are connected to alternating, straight edge portions of said central panel.

8. The bin of claim 7 wherein said triangular corner panels are located against said corner panels.

9. The bin of claim 7 wherein said foldably connected triangular corner panels and straight edge portions of said central panel are connected along scored, fold lines and said foldably connected side panels, corner panels, rectangular flaps, tapered flaps and gusset panels are connected along scored, fold lines.

10. A paperboard blank for a bulk bin, which comprises:

a plurality of alternating, foldably connected, substantially rectangular, side panels and corner panels; each of said side panels having a substantially rectangular flap, foldably connected to an edge thereof; each of said corner panels having a four-sided, tapered flap foldably connected to an edge thereof; and each of said tapered flaps and said rectangular flaps being foldably connected to a triangular gusset panel disposed between them;

the included angle in each of said gusset panels between said rectangular flaps and said tapered flaps being equal to about 180° divided by the number of said gusset panels;

the edge of each of said tapered flaps connected to said corner panels being equal to or greater in length than twice the width of said rectangular flaps times the cosine of [90° minus twice the included angle in said gusset panels between said rectangular and tapered flaps]; and said foldably connected side panels, corner panels, rectangular flaps, tapered flaps and gusset panels being connected along scored, fold lines.

11. The blank of claim 10 which includes four side panels, four corner panels, four rectangular flaps, four tapered flaps and eight gusset panels, and the included angle in each gusset panel is about 22½°.

12. A paperboard construction, comprising:

a cylinder formed from a plurality of alternating, foldably connected, substantially rectangular, upstanding side panels and corner panels; each of said side panels having a substantially rectangular flap foldably connected to the bottom edge thereof; each of said corner panels having a four-sided, tapered flap foldably connected to the bottom edge thereof; and each of said tapered flaps and said rectangular flaps being foldably connected to a triangular gusset panel, disposed between them;

said rectangular flaps, tapered flaps and gusset panels being positioned interiorly of said cylinder;

the included angle in each of said gusset panels between said rectangular flaps and said tapered flaps being equal to about 180° divided by the number of said gusset panels; and the edge of each of said tapered flaps connected to said corner panels being equal to or greater in length than twice the width of said rectangular flaps times the cosine of [90° minus twice the included angle in said gusset panels between said rectangular and tapered flaps].

13. The construction of claim 12 wherein said rectangular flaps, tapered flaps and gusset panels are horizontally disposed.

14. The construction of claim 12 wherein said foldably connected side panels, corner panels, rectangular flaps, tapered flaps and gusset panels are connected along scored, fold lines.

* * * * *